70-419 SR
10/15/85 XS 4,546,629

United States Patent [19]

Hwang

[11] Patent Number: 4,546,629

[45] Date of Patent: Oct. 15, 1985

[54] SAFETY GROOVE OF TUBULAR LOCKS

[76] Inventor: Shih M. Hwang, P.O. Box 7-369, Taipei City, 106, Taiwan

[21] Appl. No.: 482,221

[22] Filed: Apr. 5, 1983

[51] Int. Cl.[4] ..... E05B 27/08

[52] U.S. Cl. ..... 70/363; 70/419

[58] Field of Search ..... 70/363, 419, 416, 364 R, 70/364 A

[56] References Cited

U.S. PATENT DOCUMENTS

| | | | |
|---|---|---|---|
| 2,202,329 | 5/1940 | Braune | 70/419 |
| 2,283,489 | 5/1942 | Crousore | 70/419 |
| 2,629,249 | 2/1953 | Mendelsohn | 70/419 |

FOREIGN PATENT DOCUMENTS

| | | | |
|---|---|---|---|
| 1317436 | 5/1973 | United Kingdom | 70/433 |

*Primary Examiner*—Robert L. Wolfe

*Attorney, Agent, or Firm*—Cushman, Darby and Cushman

[57] ABSTRACT

A cylinder lock which prevents picking is disclosed. The lock comprises an outer shell having a cavity therein, a plug having a hole and a plurality of circumferential apertures extending partially through the plug, with grooves around the openings of the apertures. The plug is snugly disposed in the cavity. Spring biased pins are slidably received in the plug apertures. The cylinder lock also has a shaft member disposed in the cavity with a flange portion extending outwardly from said shaft member. The flange portion has a plurality of apertures with grooves around the openings of the apertures which face the plug. The apertures extend through the flange portion, and are alignable with the apertures of the plug. The shaft member passes through the hole of the plug, and is adapted to be rotated. The flange portion fits snugly in the cavity. Pins are slidably received in the flange portion apertures.

4 Claims, 19 Drawing Figures

SAFETY GROOVE OF TUBULAR LOCKS

BACKGROUND OF THE INVENTION

Although there are many different kinds of locks available on the market today, only the tubular lock, because of its special design and number of different lock combinations, is consistently installed in motorcycles, suitcases, burglar alarm devices, electrical code controllers, locks on trunks, frames, doors, windows, etc. The construction of the standard tubular lock is as follows: in FIGS. 6 and 7, flange portion (a) is fixed on the lock shaft (b). In the flange pin holes (d) on the flange portion (a), there are several flange lock pins (c) of different lengths. In the plug pin grooves (f) on the plug (e) there are springs (g) and several plug lock pins (h) of equal length. When putting lock shaft (b) through plug (e) and stop lump (k), every flange lock pin (c) is lined up with every plug lock pin (h), allowing plug lock pin (h) to pass through the flange pin hole (d) on the flange portion (a). Flange portion (a) and plug (e) are installed in the outer shell (i), and plug (e) is fixed by the fixing pin (y) through the fixing hole (z) on the outer shell (i). The upper end of the flange lock pin (c) rests against the interior of the flange of outer shell (i), as shown in FIG. 7. Since plug (e) is fixed in the outer shell (i) and plug lock pin (h) passes through the flange pin hole (d), the flange portion (a) is locked into position by the plug lock pin (h), and cannot be turned in the outer shell (i).

As shown in FIG. 6, there are several pin push grooves (m) of different depths on key (j). In the hollow interior of the key, there is a key pillar (v) (see FIG. 6-1). This key pillar (v) can be inserted in the rectangular groove (n) of lock shaft (b). When turning key (j), lock shaft (b) and flange portion (a) are driven to turn simultaneously (see FIG. 8). When key (j) is inserted into the outer shell (i), the bottoms of the pin push grooves (m) of different depths contact the upper ends of the flange lock pins (c), and drive the flange lock pins (c) and plug lock pins (h). When the fore-end of key (j) touches flange portion (a), every plug lock pin (h) is returned to plug pin groove (f) of plug (e) (flange lock pin (c) does not enter plug pin groove (f) of plug (e)). Then, turning key (j) makes lock shaft (b) and flange portion (a) turn in the outer shell (i) (plug (e) does not turn). In this way, the tubular lock can be opened. By turning shaft (b), the lock latch (s) can be driven to lock. Scewcap (t) is used to fix lock latch (s) and stop lump (k) (see FIG. 9 which is a side view of FIG. 8). When lock shaft (b) is turned stop lump (k) is also turned. When the stop mouth (p) of stop lump (k) touches the stop pillar (q) of plug (e), the stop pillar (q) will bar the key (j) from continuing to turn. Stop lump (k) is designed to prevent the turning angle of key (j) from extending the set limit.

FIG. 13 is a detailed drawing of flange lock pin (c) in flange pin hole (d), and plug lock pin (h) in plug groove (f). At the interface of flange pin hole (d) and plug pin groove (f) of a standard tubular lock, there are small rounded corners ($d_1$) ($f_1$) respectively. The functions of the small rounded corners ($d_1$) ($f_1$) are as follows: when manufacturing tubular locks, the construction must be extremely accurate, but it is very difficult to match exactly the pin push groove (m), flange lock pin (c), plug lock pin (h), flange portion (a), plug (e), etc. Thus, a small rounded corner is usually designed, to compensate for possible error when manufacturing the flange lock pin (c) and plug lock pin (h), flange portion (a), plug (e), etc. This allows smoother operation. For example: when key (j) is inserted to open the tubular lock the upper end ($h_1$) of plug lock pin (h) is not exactly on the interface of the plug (e) and flange portion (a). The common situation is where an extremely small portion of the upper end of plug lock pin ($h_1$) is in flange pin hole (d), or an extremely small portion of the upper end of flange lock pin (c) is in plug pin groove (f). When this happens, if key (j) is turned making flange portion (a) rotate, the upper end ($h_1$) of plug lock pin (h) will touch the small rounded corner ($d_1$) which pushes plug lock pin (h) into plug pin groove (f), permitting the lock to open.

Another design feature to compensate for error during manufacture is that the diameters of the flange pin hole (d) and plug pin groove (f) are made slightly larger than those of flange lock pin (c) and plug lock pin (h). If the diameter of flange pin hole (d) and plug pin groove (f) is 2.1 mm, the diameter of flange lock pin (c) and lower lock pin (h) will be about 2 mm. Therefore, there is a gap of 0.1 mm between lock pin and pin hole. This space allows flange portion (a) to turn right or left up to 0.1 mm.

The standard tubular lock can be easily opened by lock experts who use a special pick tools (FIGS. 5 & 14). The standard tubular lock then, is exposed to either burglars or experts, both of whom are capable of easily opening the lock.

FIG. 14 shows the slightly backward and release method pick tool or pick master which is equipped with steel pins (f) corresponding in number to the pins of the lock. The steel pin control-ring (con-ring) uses a screw-and-rubber-ring tightening method to control steel pins (r) and a resistance and floating ring to increase or decrease the movement of the steel pins. As demonstrated in FIGS. 10, 11 and 12, pushing these steel pins (r) separately into each flange pin hole (d), and pushing flange lock pin (c) causes plug lock pin (h) to be pushed down to the bottom of plug pin groove (f) (FIG. 10). Then, this pick tool is turned right or left continuously (it can be slightly turned because of space between the pins and the walls of the holes). The compressed springs (g) in the lock push the plug lock pin (h), the plug lock pin in turn, pushes the flange lock pin (c), and the flange lock pin (c) then pushes the steel pin (r) of the pick tool, and the steel pin (r) will withdraw. Furthermore, because the withdrawal of the steel pins (r) is controlled by the conring, every steel pin withdraws very slowly until one of the steel pins reaches the point where the ends ($h_1$) of the plug lock pins (h) are even with the openings of the plug pin grooves (f) (FIG. 12). Because flange portion (a) is continuously turned right or left by the pick tool, plug lock pin (h) moves upward and stops only when the upper end of the plug lock pin ($h_1$) touches the small round corner ($d_1$) of the flange pin groove (see FIG. 16). When the steel pins (r) drive flange portion (a) to turn right or left, plug lock pin (h) will touch the small rounded corner ($d_1$) continuously. But, as shown in FIG. 12, if the ends of the other plug pins ($h_1$) are not even with openings of the plug pin grooves, the lock pins (h) will continue to rise. Thus, only when the ends of the plug lock pins are even with the openings of the plug pin grooves, as shown in FIG. 11, is it possible to make the steel pins (r) turn the flange portion (a) to open the tubular lock.

The error-measuring pick tool is shown in FIG. 5. This tool is also equipped with steel pins (r') corresponding to the pins of the lock. The steel pins (r') are used to push flange lock pin (c) forward (FIG. 15). As with the pick master, the steel pins (r') are continuously turned to the right or left (as stated above, there is a gap of 0.1 mm between lock pin and pin hole wall), to make flange portion (a) move. When flange lock pin (c) touches the small rounded corner ($f_1$) it can be felt by hand. Then, the depth of the insertion of the steel pin (r') is recorded. One by one the other steel pins are pushed against other flange lock pins and the depths of the insertions of all steel pins are recorded. In this way, the depth necessary to make each steel pin push each plug lock pin into its plug pin groove is determined. Likewise, it can be measured whether each flange lock pin (c) fits exactly in its flange pin hole (d) and whether each plug lock pin (h) is in the correct position in its plug pin groove. Thus, by turning steel pins (r'), the flange portion can be turned and the lock opened. Although pick tools can be used to take advantage of the error between the hole and pin and the synchronization of the corners ($d_1$) or ($f_1$) to open the standard tubular lock, the tubular lock of the present invention prevents a burglar from taking advantage of these design characteristics.

SUMMARY OF THE INVENTION

The present invention relates to a cylinder lock which prevents picking. The lock comprises an outer shell having a cavity therein, a plug having a hole and a plurality of circumferential apertures extending partially through the plug, with grooves around the openings of the apertures. The plug is snugly disposed in the cavity. Spring biased pins are slidably received in the plug apertures. The cylinder lock also has a shaft member disposed in the cavity with a flange portion extending outwardly from the shaft member. The flange portion has a plurality of apertures with grooves around the openings of the apertures which face the plug. The aperatures extend through the flange portion, and are alignable with the apertures of the plug. The shaft member passes through the hole of the plug, and is adaptable to be rotated. The flange portion fits snugly in the cavity. Pins are slidably received in the flange portion apertures.

DETAILED DESCRIPTION OF THE INVENTION

Figure 1A:
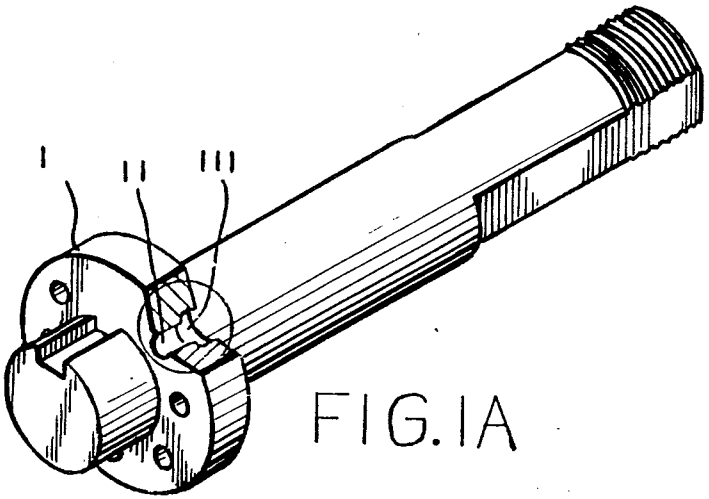
FIG. 1*a* shows a dissection of the shaft and flange portion of this invention.
Figure 1B:
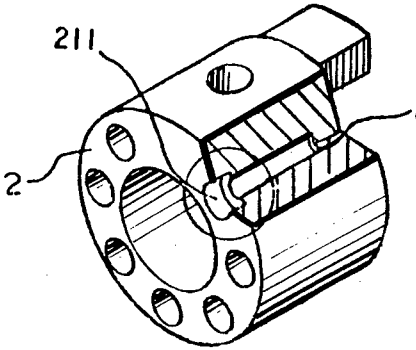
FIG. 1*b* shows a dissection of the plug.
Figure 1C:
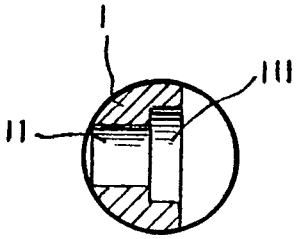
FIG. 1*c* shows a side view of the safety groove (111) of flange portion (1).
Figure 1D:
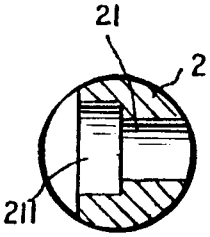
FIG. 1*d* shows the side view of the safety groove of the plug (2).
Figure 2:
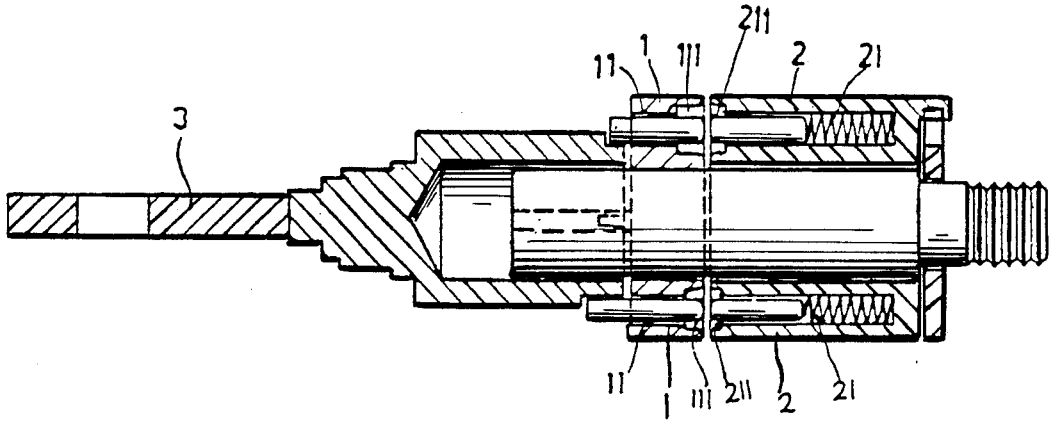
FIG. 2 shows the use of the invention.

A sectional view of the flange portion 1 of this invention is shown in FIG. 1A. At the bottom of each flange pin hole 11 of flange portion 1, there is a safety groove 111. Each safety groove on flange pin hole is of a different depth. FIG. 1*c* is a side view of the safety groove 111 of flange portion 1. FIG. 1*b* is a sectional view of the plug 2. On the upper end of each plug pin groove 21 on plug 2, there is a safety groove 211. Each safety groove on plug pin groove is of a different depth. FIG. 1*d* is the side view of the safety groove 211 of plug 2. When flange portion 1 and plug 2 are connected, the safety groove 111 on flange portion 1 and safety grooves 211 on plug 2 are positioned opposite each other; one is to the left and the other to the right. FIG. 2 shows the flange portion 1 adjacent to the plug 2. After inserting and turning key 3 to drive the flange portion 1 to turn, the tubular lock can be opened or locked.

Figure 3:
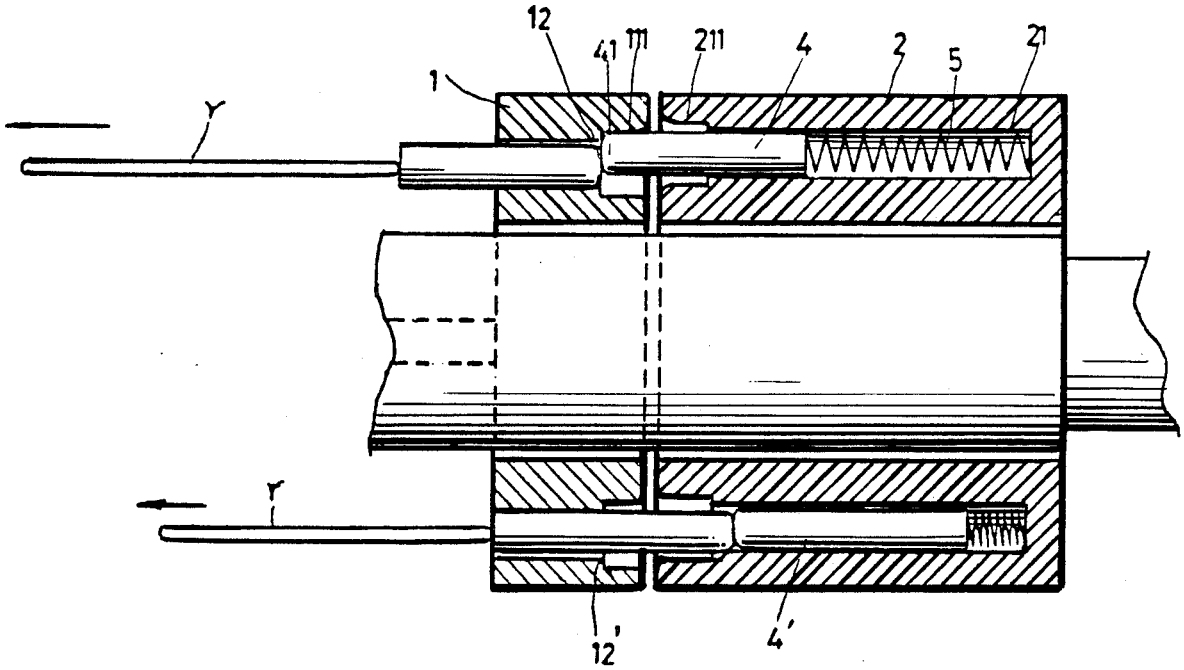
FIG. 3 shows an attempted opening of the invention by slightly backward & release method pick tool or pick master.
Figure 14:
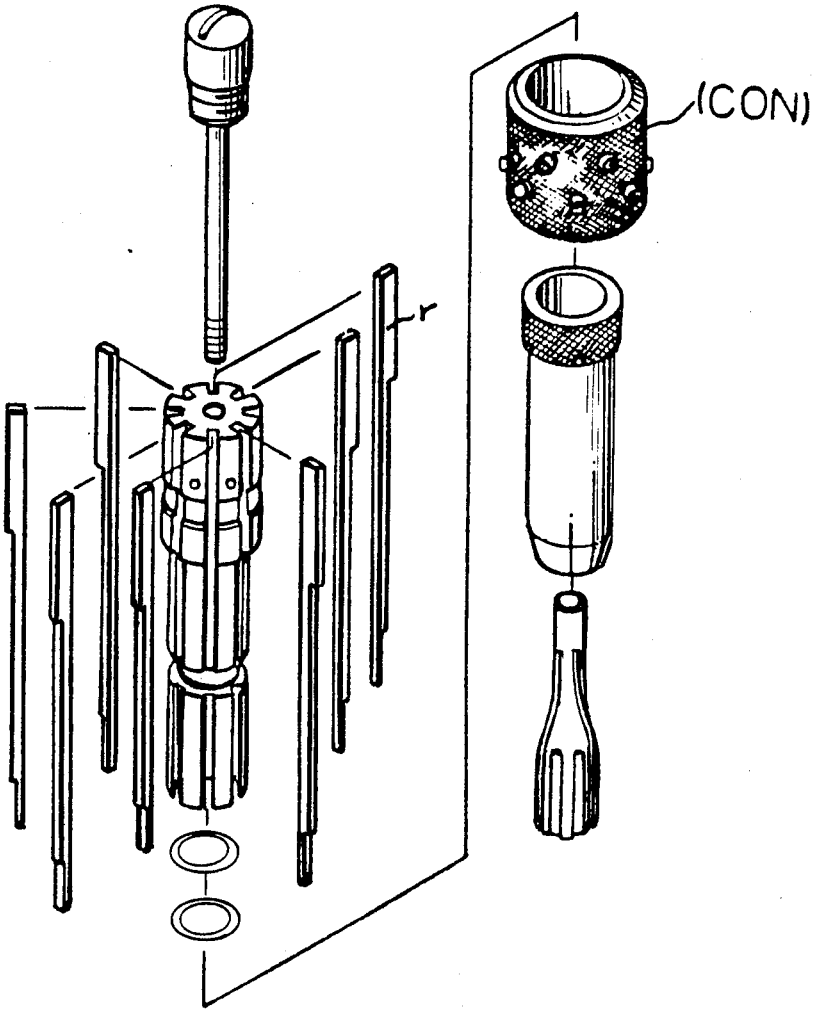
FIG. 14 shows a slightly backward & release method pick tool or pick master.
Figure 15:
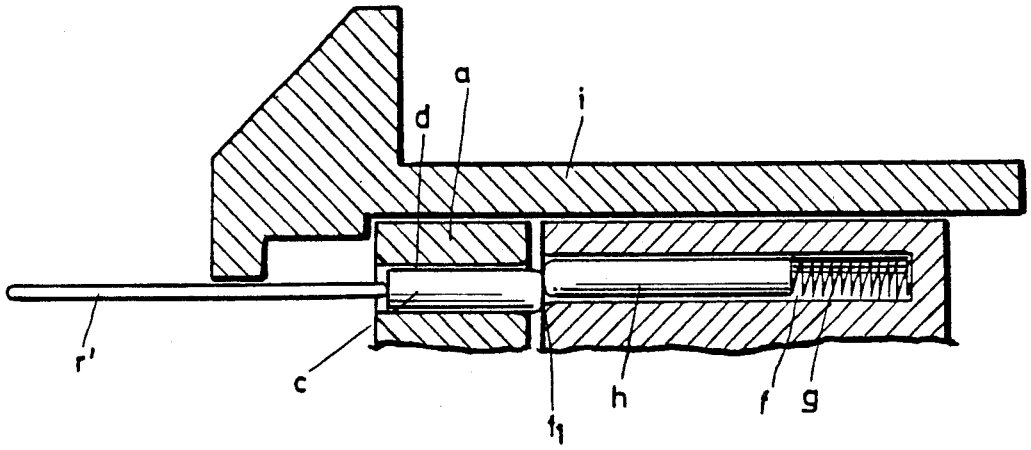
FIG. 15 shows the opening of the standard tubular lock by error-measuring pick tool.
Figure 16:
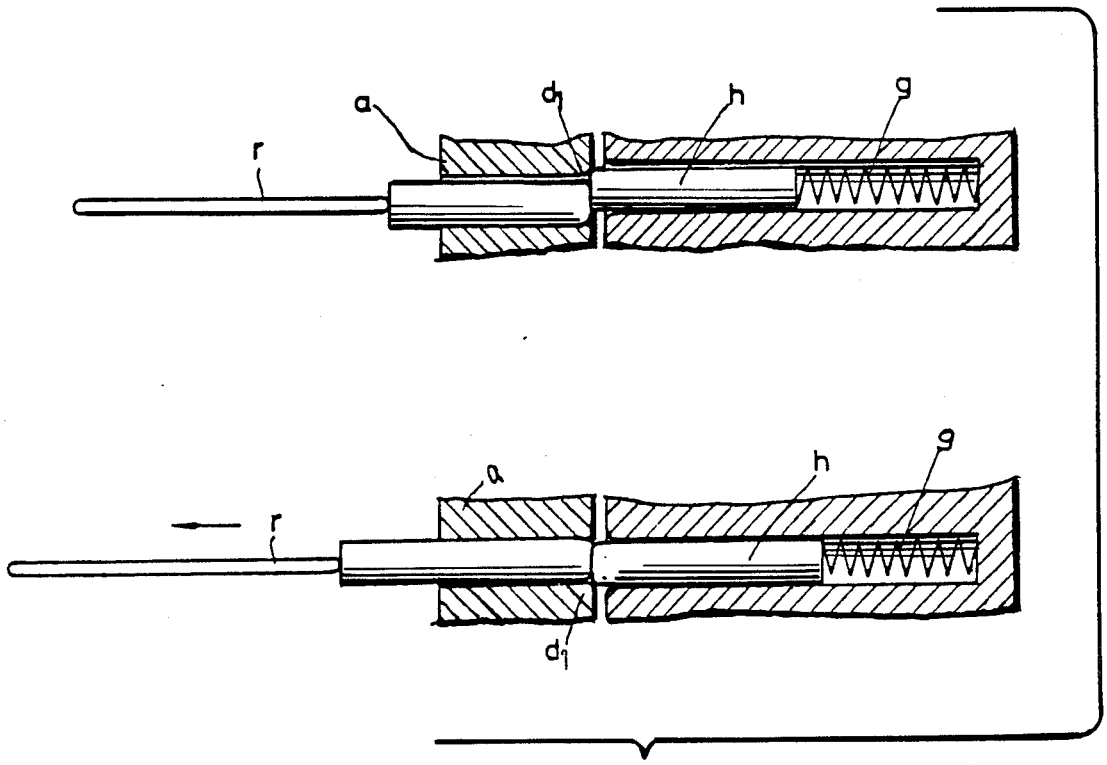
FIG. 16 demonstrates that a plug lock pin cannot move backward when it is continually touching the rounded corner.

Use of the slightly backward and release method pick tool or pick master (as shown in FIG. 14) on the present invention is shown in FIG. 3. With the flange portion 1 turned slightly right or left, plug lock pin 4 is pushed upward by spring 5. The lock pin 4 passes through the interface of the flange portion and the plug, and the upper end 41 of plug lock pin 4 touches the groove bottom 12 of flange portion 1. When all plug lock pins 4, 4' reach their positions on the groove bottoms 12, 12', these plug lock pins 4, 4' will have completely entered safety grooves 111 of flange portion 1. If the pick master is turned, safety grooves 111 will be chucked by the plug lock pins 4, 4', and flange portion 1 will not turn any further. Therefore, the pick master cannot open the tubular lock of this invention.

Figure 4:
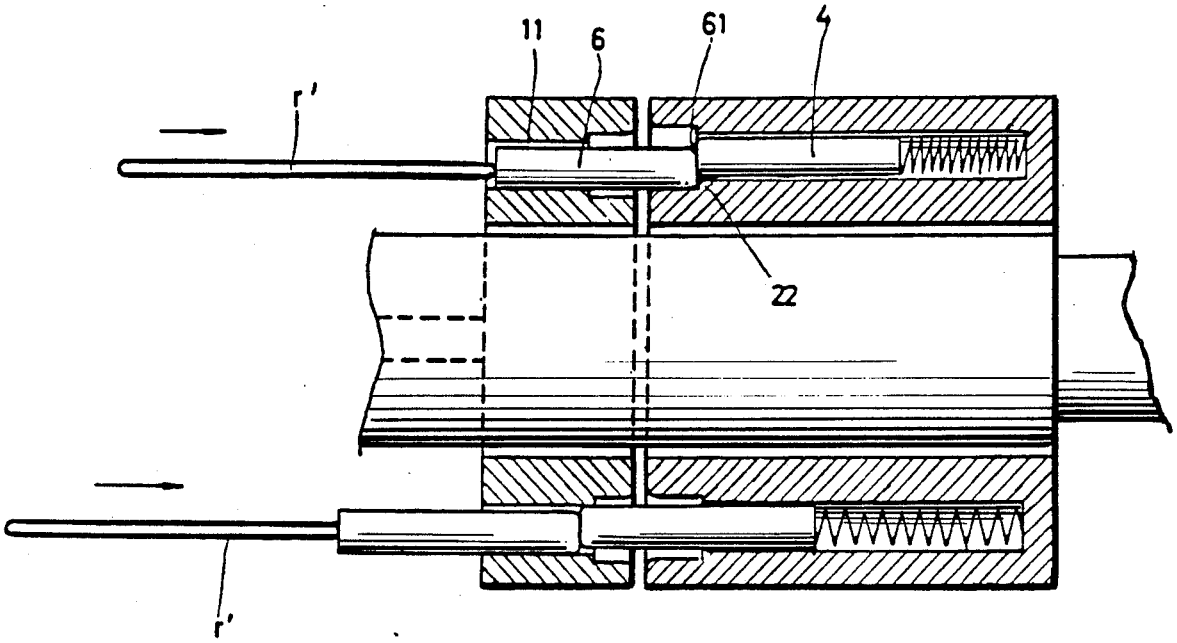
FIG. 4 shows an attempted opening of the invention by error-measuring pick tool.
Figure 5:
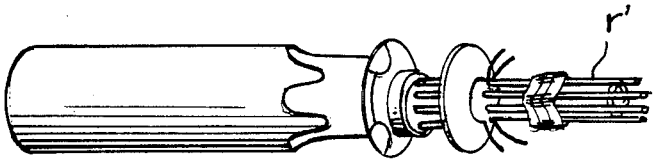
FIG. 5 shows an error-measuring pick tool.
Figures 1, 6:
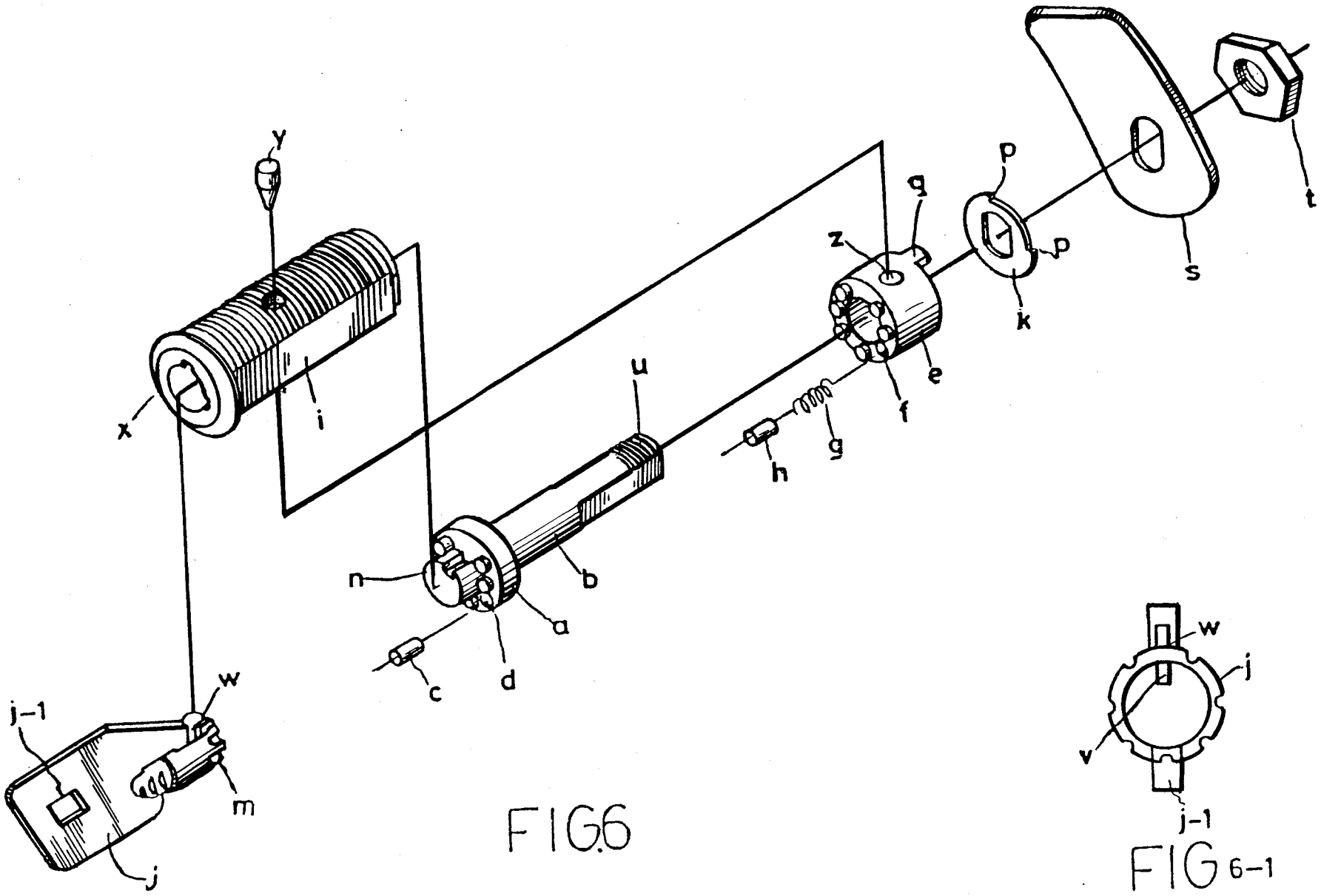
FIG. 6 is an exploded view of a standard tubular lock.
Figure 7:
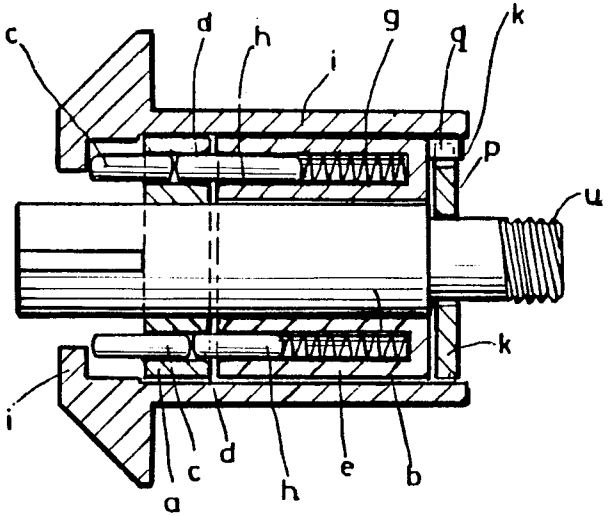
FIG. 7 is a sectional view of standard tubular lock.
Figure 8:
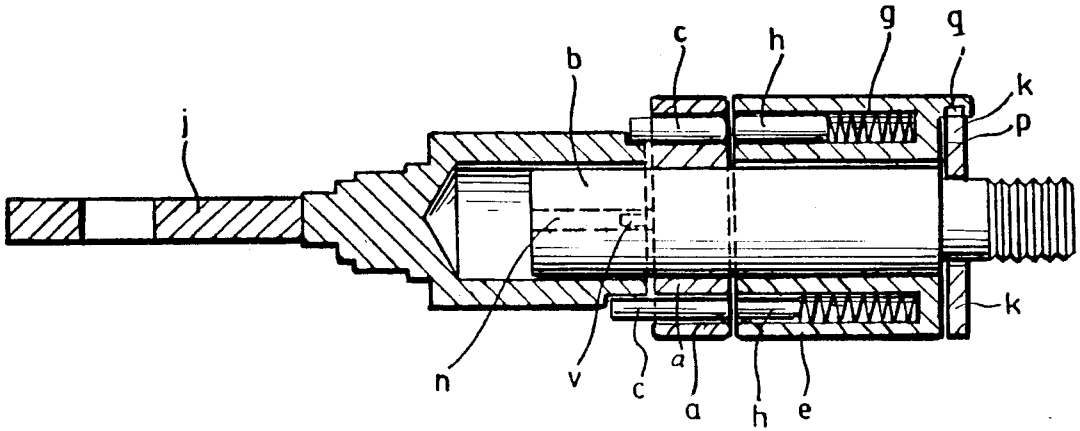
FIG. 8 is a sectional view of standard tubular lock in which a key is installed.
Figure 9:
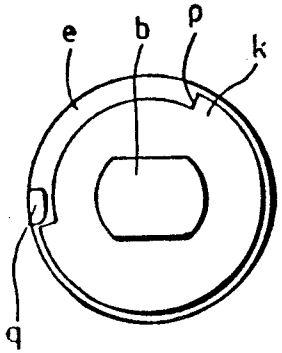
FIG. 9 is a side view of the standard tubular lock in FIG. 8.
Figure 11:
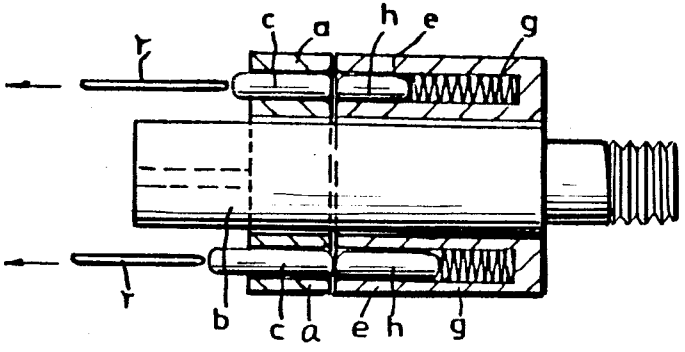
FIGS. 10, 11 and 12 show the opening of the standard tubular lock by a slightly backward & release method pick tool or pick master.
Figure 10:
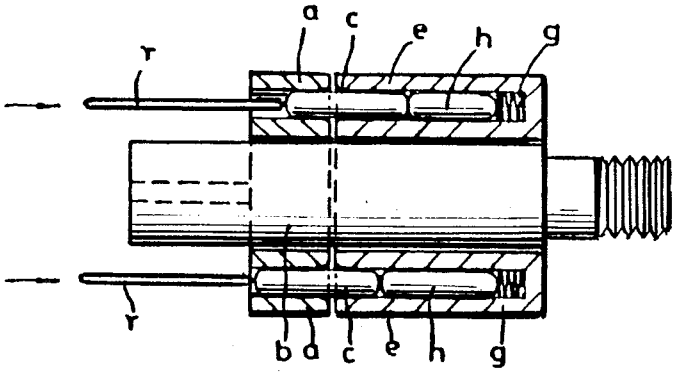
Figure 12:
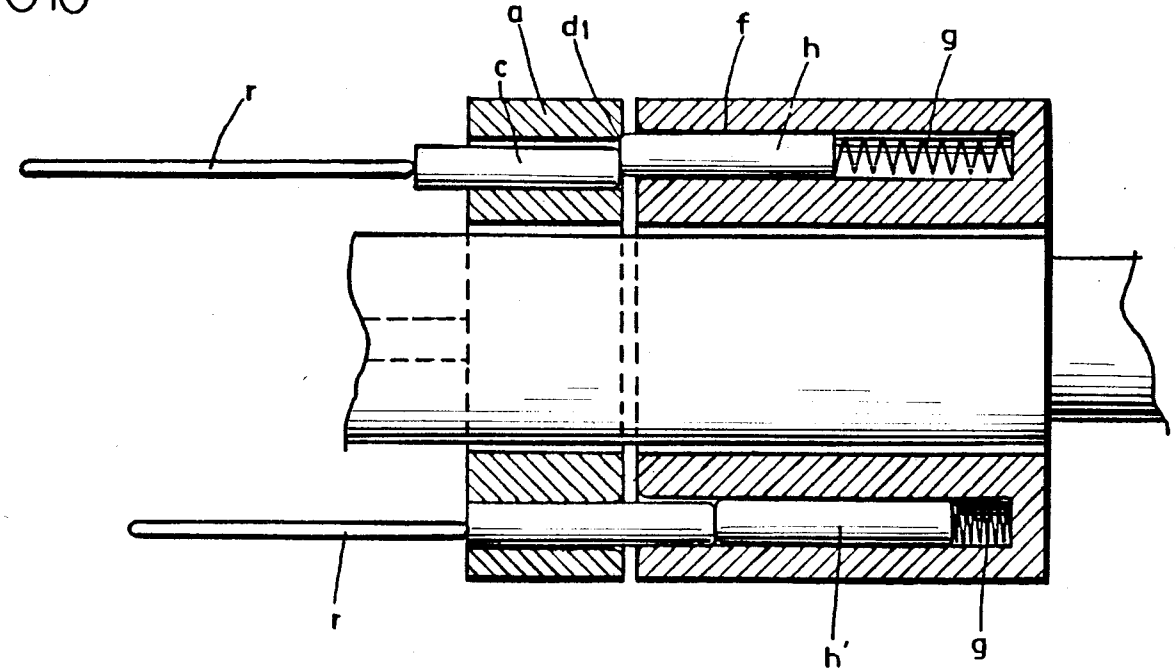
Figure 13:
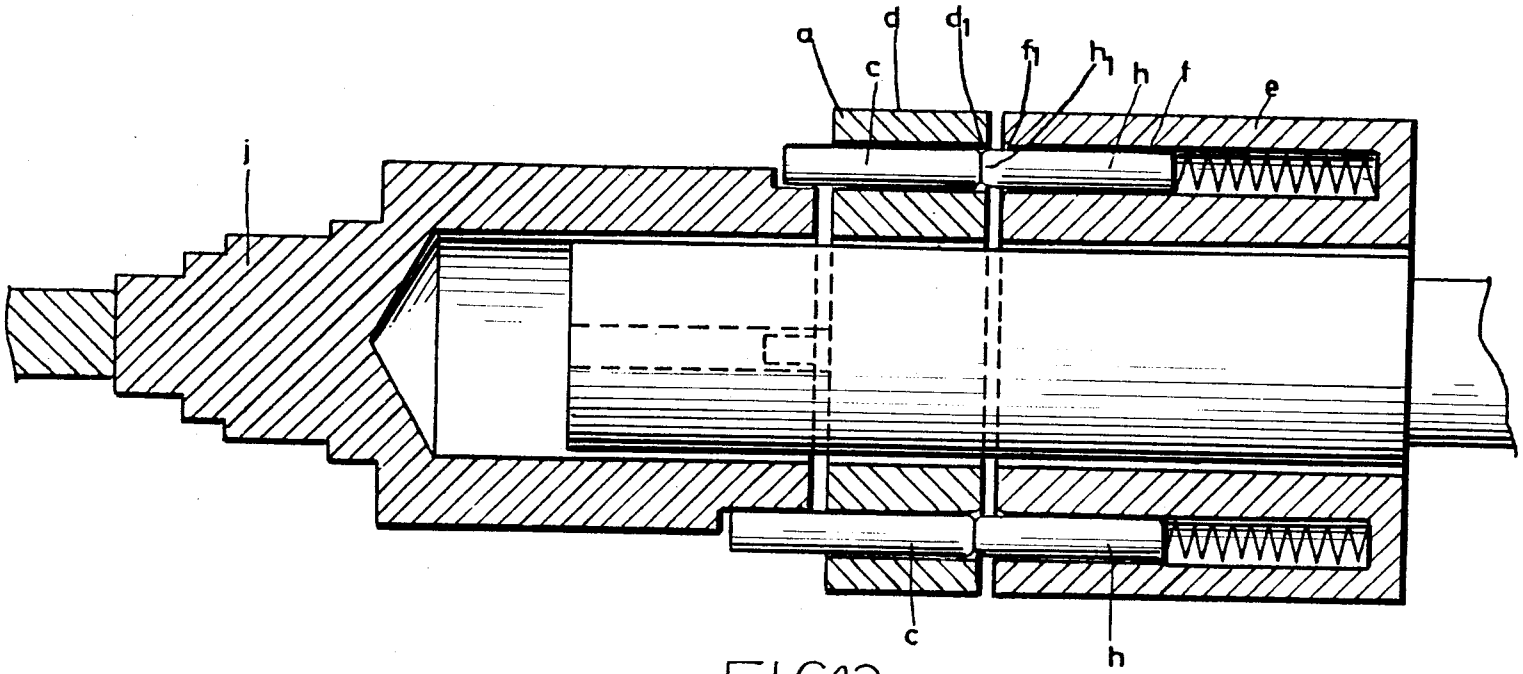
FIG. 13 is a structural drawing of the standard tubular lock.

Use of the error-measuring pick tool (as shown in FIG. 5) on the present invention is shown in FIG. 4. When the upper ends 61 of all flange lock pins 6 touch the groove bottoms 22 of plug 2, the flange lock pins 6 will have entered the safety groove 211 of plug 2. If the pick tool is turned, the safety grooves 211 will be chucked by flange lock pins 6, and the flange portion 1 will not turn. Therefore, the tubular lock cannot be opened by the pick tool.

In order to raise the safety level of the lock, the invention has been designed so that the safety grooves 111 of each pin hole of the flange portion 1 and the safety grooves 211 of each pin hole of the plug 2 are all of the different depths.

The above statements show the structure of this invention is extremely detailed, and that only with the right key can be lock be opened. Therefore, the tubular lock is unparalleled in providing safety.

I claim:

1. A cylinder lock comprising:

an outer shell having first and second ends forming a cavity extending between and opening at said first and second ends, said first end having an annular flange extending inwardly therefrom;

a plug having front and rear sides and having a hole therethrough along its axis and having a plurality of first circumferential apertures extending from said front side partially through said plug, each aperature having an axis parallel to the axis of said hole, said plug having first grooves on said front side extending around said first circumferential apertures, said plug being disposed in said cavity and fixed snugly to an interior wall of said outer shell;

spring biased first pins slidably received in said first circumferential apertures;

a shaft member having a flange portion having a front face and a rear face extending outwardly therefrom and having a plurality of second circumferential apertures extending through said flange portion alignable with said first circumferential apertures, said flange portion having second grooves on said rear face extending around said second circumferential apertures, said shaft member being disposed in said cavity passing through said hole of said plug, said shaft member being adapted to be rotated therein, said flange portion fitting snugly against said interior wall of said outer shell; and second pins slidably received in said second circumferential apertures.

2. The cylinder lock of claim 1 wherein said first grooves are of different depths.

3. The cylinder lock of claim 2 wherein said second grooves are of different depths.

4. The cylinder lock of claim 1 wherein said second pins are different lengths.

* * * * *